US008167408B2

(12) United States Patent
Shimamura

(10) Patent No.: US 8,167,408 B2
(45) Date of Patent: May 1, 2012

(54) INK JET RECORDING HEAD, AND METHOD FOR MANUFACTURING INK JET RECORDING HEAD

(75) Inventor: Ryo Shimamura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 851 days.

(21) Appl. No.: 12/060,581

(22) Filed: Apr. 1, 2008

(65) Prior Publication Data

US 2008/0246810 A1 Oct. 9, 2008

(30) Foreign Application Priority Data

Apr. 2, 2007 (JP) ..... 2007-096408

(51) Int. Cl.
*B41J 2/14* (2006.01)

(52) U.S. Cl. ..... 347/50

(58) Field of Classification Search ..... 347/50
See application file for complete search history.

(56) References Cited

U.S. PATENT DOCUMENTS 6,084,612 A * 7/2000 Suzuki et al. ..... 347/50
6,499,823 B2 12/2002 Okazaki et al.
6,869,168 B2 * 3/2005 Terui ..... 347/50
7,025,441 B2 * 4/2006 Kashino et al. ..... 347/50
7,118,199 B2 10/2006 Mori
7,452,057 B2 * 11/2008 Essen et al. ..... 347/50
7,712,870 B2 * 5/2010 Shibata et al. ..... 347/50
7,771,020 B2 * 8/2010 Miyazaki et al. ..... 347/50
2002/0118254 A1 * 8/2002 Wong et al. ..... 347/50
2008/0246810 A1 * 10/2008 Shimamura ..... 347/50

FOREIGN PATENT DOCUMENTS

JP 10-44442 2/1998
JP 2004-255866 9/2004

* cited by examiner

*Primary Examiner* — Charlie Peng
(74) *Attorney, Agent, or Firm* — Fitzpatrick, Cella, Harper & Scinto

(57) ABSTRACT

An ink jet recording head includes a recording element substrate; an electric wiring member including an array of leads connected to the recording element substrate at an electrical connecting portion; a supporting portion including a surface supporting the electric wiring member and a recessed bottom surface for supporting the recording element substrate; sealing material covering a part of an upper surface of the electric wiring member, the electrical connecting portion, a part of an upper surface of the recording element substrate, and the array of leads; and a projection provided between the electric wiring member and the recording element substrate at an end of the array. A level difference between upper surfaces of the projection and the recording element substrate is smaller than a level difference between the upper surfaces of the recording element substrate and the electric wiring member.

6 Claims, 12 Drawing Sheets

INK JET RECORDING HEAD, AND METHOD FOR MANUFACTURING INK JET RECORDING HEAD

FIELD OF THE INVENTION AND RELATED ART

The present invention relates to an ink jet recording head, that is, a recording head which records an image on recording medium by jetting droplets of ink as recording liquid. It also relates to a method for manufacturing an ink jet recording head.

FIGS. 14A and 14B show the general structure of an ink jet recording head (which hereafter will be referred to simply as "recording head") in accordance with the prior art. The recording head shown in the drawings is made up of an ink container 100, a recording element chip 200, and an electrical wiring board 300. Not only does the ink container 100 store ink, but also, serves as a supporting member, to which the recording element chip 200 and electrical wiring board 300 (which hereafter will be referred to simply as "wiring board") are attached. Further, the recording element chip 200 and wiring board 300 are in connection with each other. They are connected by the following method. That is, unshown electrically conductive pads (electrodes), for example, metallic pads (bump made by gold plating, for example), are formed on the recording element chip 200 by a film forming process, a photolithographic process, a plating process, or the like. Then, the multiple leads with which the wiring board 300 is provided are bonded with the pads (electrodes) of the recording element chip 200 by the application of heat and load (which hereafter may be referred to as "inner lead bonding", or ILB). It should be noted here that after the bonding of the pads (electrodes) of the recording element chip 200 with the leads of the wiring board 300, the recording element chip 200 is bonded to the ink container 100 with adhesive, in order to prevent ink from leaking while it is supplied to the recording element chip 200 from the ink container 100 through the ink outlet of the ink container 100.

It is possible that if the ink having adhered to the surface of the recording element chip 200, at which the ink jetting outlets are open, flows onto the wiring board 300 which holds wiring formed of copper foil or the like, the ink may cause the wiring board 300 to short-circuit and/or corrode. Thus, in order to prevent this problem, the wiring board 300 is covered with a piece of cover film, on the side where the circuit formed of copper foil is present. The wiring board 300 is bonded to the ink container 100 with adhesive, by the side covered with the cover film.

Further, the peripheries of the recording element chip 200 is sealed with a first sealant 400. In this specification, the sealing of the peripheries of the recording element chip 200 may be sometimes referred to as "peripheral sealing of chip". It is possible that if the junction (electrical junction) between the pad (electrode) of the recording element chip 200 and the lead of the wiring board 300 becomes exposed, the minute ink droplets or the like having scattered from the ink jetting outlets will adhere to the junction and corrode it. Therefore, the electrical junctions are sealed with a second sealant 500, which is formed of epoxy resin or the like, which is excellent as a sealant as well as an ion blocker. In this specification of the present invention, the sealing of the electrical joint by sealant may be sometimes referred to as "sealing of electrical junction".

The first and second sealants 400 and 500, which are used for the sealing of the peripheries of the recording element chip 200 and the sealing of the electrical junctions, respectively, are thermally hardened (cured).

FIGS. 15(A), 15(B), and 15(C) are schematic plan views of the recording head shown in FIG. 14, and show the states of the recording head, respectively, in which the recording head will be after the completion of the various steps in the manufacturing of the recording head.

FIG. 15A shows the state of the precursor of the recording head, in which the precursor will be after the wiring board 300, and the recording element chip 200 connected to the wiring board 300, are attached to the ink container 100. FIG. 15(B) shows the state of the precursor of the recording head, in which the precursor will be after the application of the first sealant 400 to the peripheries of the recording element chip 200. FIG. 15C shows the state of the precursor of the recording head, in which the precursor will be after the application of the second sealant 500 to the electrical junctions between the wiring board 300 and recording element chip 200.

As the sealant 400 for sealing the peripheries of the recording element chip, such a sealant that is highly fluid and is unlikely to stress the recording element chip as it hardens and/or after it hardens, is selected. On the other hand, as the second sealant 500 for sealing the electrical junctions formed by ILB, such a sealant that is significantly harder than the sealant used as the sealant 400 after it hardens is selected, in consideration of the durability related to the following facts. That is, the surface of the recording element chip, at which the ink jetting outlets are open, is wiped, as necessary, by a wiper blade, in order to remove the ink droplets having adhered to the surface. Therefore, the second sealant 500 is required to be hard enough to be resistant to friction wear. Further, it is possible that the second sealant 500 will come into contact with recording medium. Therefore, it is required that the second sealant 500 does not peel even if it comes into contact with recording medium.

Next, the sealing step will be described in more detail. Referring to FIGS. 15B and 15C, the sealing step, which is one of the steps in an ink jet recording manufacturing process, is carried out in the order of the sealing of the peripheries of the recording element chip and the sealing of the electrical junctions made by ILB. Normally, a necessary amount of sealant is applied to the preselected areas of the recording head, with the use of a three axis robot (X-Y-Z axis robot), a dispenser, a syringe, a needle, etc.

FIG. 16 is a schematic drawing which shows how the electrical junctions made by ILB is sealed. As will be evident from the drawing, the second sealant 500 is applied onto the leads 301, and the first sealing member 400 (applied in advance), by a needle 600, which is moved in the direction indicated by an arrow mark.

It should be noted here that capillary force caused the first sealant 400, that is, the sealant which was applied in advance to the peripheries of the recording element chip 200, to fill every nook and corner of the abovementioned electrical junctions. Further, as the first sealant 400 was applied, the body of first sealant 400 between the adjacent two leads 301 was pulled upward by its surface tension, as high as the highest point of the leads 301. Therefore, the body of first sealant 400 between the adjacent two leads 301 remains in the form into which the balance between its weight and the surface tension shaped it. The second sealant 500 is to be applied onto the first sealant 400 while the first sealant 400 is in the above-described state. As the second sealant 500 is applied, it airtightly adheres to the layer of first sealant 400.

However, there occurred sometimes the following problem. That is, at the beginning and/or end of the step for applying the second sealant 500, the second sealant 500 sank into the uncured layer of the first sealant 400, and as it sank, it sometimes partially exposed the lead(s) 301, allowing thereby ink to come into contact with the exposed portion(s) of leads, which resulted in electrical problems.

As for the solution to this problem, in the past, the following means have been adopted. That is, Japanese Laid-open Patent Application 2004-255866 discloses a liquid jetting head which had a significantly reduced distance between the edges of the recording element chip placement hole of the wiring board, and the corresponding edges of the recording element chip, compared to that of a liquid jetting head in accordance with the prior art. Further, Japanese Laid-open Patent Application H10-44442 discloses a liquid jetting head, which is provided with dummy leads for preventing the sealant from sinking after the sealant is applied. A dummy lead is a lead which does not have an electrical connection with a recording element chip. It is shorter than a normal lead, and is positioned next to the outermost lead of the group of leads arranged in parallel in the direction perpendicular to that in which the leads extend.

However, even in the case of the structural arrangement such as those disclosed in Japanese Laid-open Patent Applications 2004-255866 and H10-44442, there is a significant amount of difference in height between the top surface of the wiring board and the top surface of the recording element chip, which are partially coated with sealant(s) to cover the electrical junctions formed by ILB. This difference in height (step) is intentionally provided in order to prevent the "edge touch", which is a phenomenon that the leads come into contact with the corner(s) of the lateral surface(s) of the recording element chip. That is, the design of the ink jet recording heads is such that as the recording element chip and wiring board are put together, the top surface of the wiring board is positioned higher than the top surface of the recording element chip. Further, referring to FIG. 17 (which is an enlarged view of the adjacencies of the electrical junction shown in FIG. 15B), the wiring board is provided with overhangs 303, which are provided to position the wiring board 300 as close as possible to the recording element chip 200 to support the second sealant 500 with the portion 303 to prevent the second sealant 500 from sinking. This design makes steeper the virtual line which connects the edge of the top surface of the wiring board 300 and the edge of the top surface of the recording element chip 200.

The presence of this significant amount of difference in height (step) between the top surface of the wiring board 300 and the top surface of recording element chip 200 sometimes causes the body of sealant to be applied across the area which corresponds to the abovementioned virtual line which connects the edge of the top surface of the wiring board 300 and the edge of the top surface of the recording element chip 200, to become "constricted", that is, narrow (in terms of direction perpendicular to direction in which sealant is applied). If the body of sealant applied across the abovementioned area narrows by a large amount, it is possible that the lead(s) is partially exposed. If ink comes into contact with the exposed portion of a lead, electrical problems occur.

To concretely describe the cause of the above described narrowing of the body of applied sealant, referring to FIG. 18, there is an intentionally provided difference 800 (which is 0.1-0.15 mm) in height between the portion of the top surface of the wiring board 300, across which the second sealant member 500 (FIG. 6) is applied, and the top surface of the recording element chip 200.

In FIG. 19A, the second sealant 500 is applied across the aforementioned electrical junctions and their adjacencies, inclusive of where the abovementioned step is present. It is applied with a needle 600. It is applied from the left-to-right direction of the drawing, while moving the needle 600 at a preset speed, and causing the needle 600 to extrude the sealant 500 at a preset rate.

While the needle 600 is moved across the area above the electrical junctions and their adjacencies (step 800 in FIG. 18), that is, the area between the top surface of the wiring board and the top surface of the recording element chip, that is, while applying the second sealant 500 in the high-to-low direction, a part or parts of the electrical junctions and their adjacencies fail to be coated with the second sealant 500. That is, while the needle 600 is moved across the immediately downstream or upstream side of the wiring board 300, the body of second sealant 500 extruded from the needle 600 fails to completely cover the area to be covered, because the amount by which the second sealant 500 is extruded per unit length of time is insufficient to cover the entirety of the area to be covered by the second sealant 500. Thus, the body of applied second sealant 500 locally narrows in terms of the direction perpendicular to the direction in which the second sealant 500 is applied. The thus created narrow portion of the body of applied second sealant 500 is the abovementioned "constricted portion" of the second sealant 500.

To describe the cause of the narrowing of the body of applied second sealant in more detail with reference to FIG. 19B, while the needle 600 is moved in the direction indicated by an arrow mark in the drawing to apply the second sealant 500, as long as the rate (Q) at which the second sealant 500 is applied, the moving speed of the needle 600, and the special volume ((size of area which can be covered with second sealant 500, by needle 600)×distance V from portion of surface to be covered to tip of needle 600) remain constant (V1=V2), the body of sealant extruded from the needle 600 continuously forms a belt of second sealant 500 which is uniform in width.

In reality, however, while the needle 600 is moved across the edge of the wiring board and the immediately downstream side of the edge of the wiring board, the special volume V, that is, the volume of the space formed by the needle tip and the surface to be coated, suddenly changes (V1<V2). Thus, the needle 600 temporarily fails to supply the area with a sufficient amount of second sealant 500. As a result, these areas are not coated with the second sealant 500. In other words, each time the needle 600 fails to supply the second sealant 500 in the amount sufficient to accommodate the changes in the above described spatial volume V, the narrowing 700 of the body of applied second sealant 500 occurs. This phenomenon is likely to occur as the distance from the tip of the needle 600 to the surface to be coated suddenly increases, that is, when the needle 600 is moved across the edge of the wiring board 300 in the abovementioned direction. Further, the greater the application speed, the larger the portion of the area to be coated with the second sealant 500 which will fail to be coated, and therefore, the more conspicuous the narrowing 700 of the body of applied second sealant 500.

If it is possible to eliminate the difference 800 in height, which is present between the top surface of the wiring board and the top surface of the recording element chip, it is possible to prevent the occurrence of the narrowing. However, this step difference 800 in height is intentionally provided to prevent the "edge touch", as described above. Therefore, it is not allowed to eliminate the difference 800 in height to make the top surface of the wiring board level with the top surface of the recording element chip.

Further, when it is necessary to shorten the processing time for productivity, and/or if the length by which the sealant is to be applied becomes longer, because the recording element chip is widened for image quality, and therefore, the number of electrical junctions formed by ILB increases, the speed at which the sealant is applied must be further increased. However, it is possible that the increase in the sealant application speed results in the more frequent occurrence of the narrowing of the second sealant attributable to the above described step difference in height between the wiring board and recording element chip, which might result in the decline in productivity as well as yield.

SUMMARY OF THE INVENTION

Thus, the present invention can provide an ink jet recording head, having a wiring board and recording element chip which are different in height relative to where the recording element chip is attached, being thereby prevented from making direct contact with each other, and having a second sealant which does not have a constricted (narrow) portion.

According to an aspect of the present invention, there is provided an ink jet recording head comprising a recording element substrate having an ejection outlet for ejecting ink; an electric wiring member connected to said recording element substrate at an electrical connecting portion to supply electric power to said recording element substrate, said electric wiring member including an array of leads; a supporting portion for supporting said recording element substrate and said electric wiring member, said supporting portion includes a surface supporting said electric wiring member and a recessed bottom surface for supporting said recording element substrate, wherein said supporting surface is recessed in a recess of the bottom surface; a sealed region of sealing material sealing said electric wiring member, said sealed region covering a part of an upper surface of said electric wiring member, the electrical connecting portion, a part of an upper surface of said recording element substrate, and said array of leads; and a projection provided between said electric wiring member and said recording element substrate at an end, with respect to a direction of arrangement of the array, of said array in said sealed region, wherein a level difference between an upper surface of said projection and an upper surface of said recording element substrate is smaller than a level difference between the upper surface of said recording element substrate and the upper surface of said electric wiring member.

According to another aspect of the present invention, there is provided a manufacturing method for an ink jet recording head, said method comprising a step of preparing a recording element substrate having an ejection outlet for ejecting ink; a step of preparing an electric wiring member connected to said recording element substrate at an electrical connecting portion to supply electric power to said recording element substrate, said electric wiring member including an array of leads; a step of preparing a supporting portion for supporting said recording element substrate and said electric wiring member, said supporting portion includes a surface supporting said electric wiring member and a recessed bottom surface for supporting said recording element substrate, wherein said supporting surface is recessed in a recess of the bottom surface; a step of providing a projection between said electric wiring member and said recording element substrate at an end, with respect to a direction of arrangement of the array, of said array in said sealed region, wherein a level difference between an upper surface of said projection and an upper surface of said recording element substrate is smaller than a level difference between the upper surface of said recording element substrate and the upper surface of said electric wiring member; and a step of applying sealing material, along the direction from a side where said projection is provided, to provide a sealed region to seal said electric wiring member, said sealed region covering a part of an upper surface of said electric wiring member, the electrical connecting portion, a part of an upper surface of said recording element substrate, and said array of leads.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

Hereinafter, the ink jet recording head (which hereafter will be referred to as "recording head") in one of the preferred embodiments of the present invention will be described in detail with reference to the appended drawings.

Figure 1:
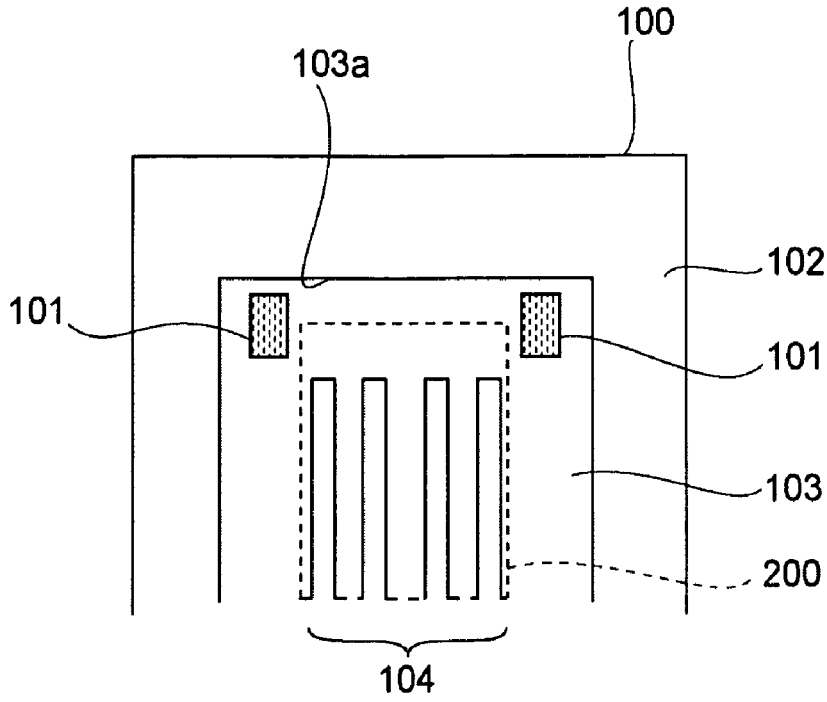
FIG. 1 is a schematic plan view of a part of the bottom of the ink container of the ink jet recording head in the first embodiment of the present invention, showing the downwardly facing side of the ink container.

FIG. 1 is a plan view of the bottom of the ink container 100 of the recording head in this embodiment, and shows the structure of the bottom. As will be evident from the drawing, the bottom surface of the ink container 100 is provided with a wiring board attachment area 102, that is, the area to which the wiring board 300 (FIG. 2) is bonded with adhesive. The area 102 is the bottom surface, in true sense, of the ink container 100, which supports the wiring board 300. The wiring board supporting area 102 is provided with a recess 103, which occupies the center portion of the area 102, and the bottom surface 103*b* of which is recessed by a preset distance from the wiring board supporting area 102. It is to the bottom surface 103*b* of the recess 103 that the recording element chip 200 is bonded with adhesive. In other words, the ink container 100 doubles as the component which supports the recording element chip 200 and wiring board 300.

The ink container 100 is also provided with multiple ink outlets 104 through which ink is supplied to the recording element chip 200 from the ink container 100 (unshown), and which open at the bottom surface 103*b* of the recess 103. After ink is supplied to the recording element chip 200, it is jetted, in the form of an ink droplet, out of the recording element chip 200 through the ink outlets of the recording element chip 200, toward recording medium.

The ink container 100 is also provided with four projections 101, which are integral with the ink container 100. The four projections 101 protrude from the four corner areas of the bottom surface 103*b* of the recess 103, one for one (drawing shows only two of four projections 101). More specifically, each projection 101 is formed as an integral part of the ink container 100, of a resinous substance. Incidentally, the projection 101 does not need to be an integral part of the ink container 100. That is, it may be attached to the ink container 100 after being formed independently from the ink container 100. From the standpoint of the object of the present invention, even if the projection 101 is not formed as an integral part of the ink container 100, its effect is the same as that of the one formed as an integral part of the ink container 100.

Figure 2:
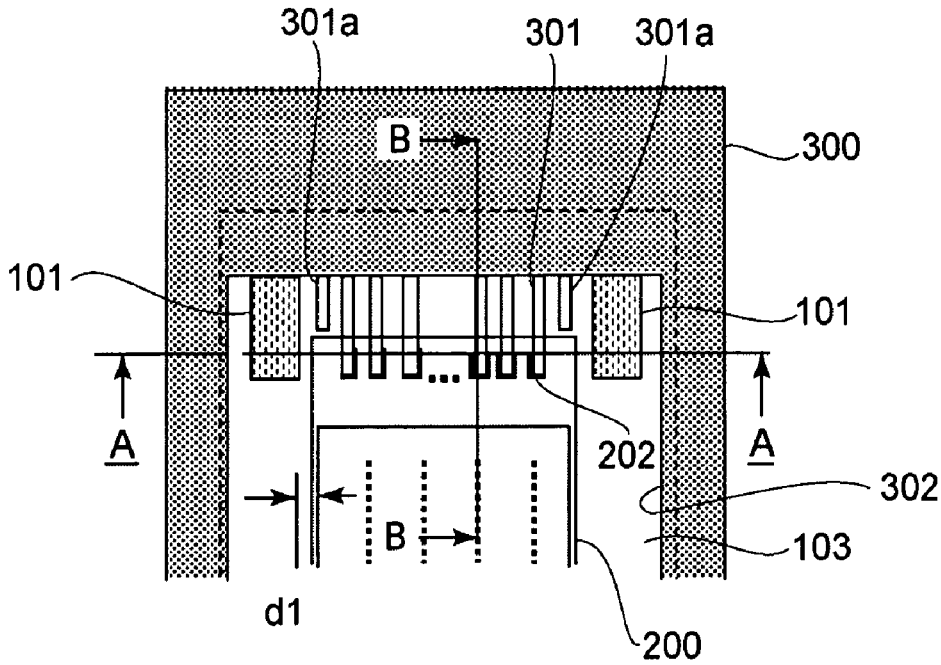
FIG. 2 is a schematic plan view of a part of the downwardly facing side of the ink container of the ink jet recording head shown in FIG. 1, showing the bottom surface of the ink container, to which the recording element chip and wiring board have been attached.

Referring to FIG. 2, the recording element chip 200 is provided with multiple metallic bumps 202, which are formed by plating, whereas the wiring board 300 is provided with multiple leads 301. The recording head 200 is fitted in the recess 103, and its bumps 202 are bonded with the multiple leads 301 of the wiring board 300, one for one, establishing electrical connection between the recording head 200 and wiring board 300. Thus, the electric power for driving the ink jet recording head can be transmitted to the recording element chip 200 from an external power source. More concretely, the multiple leads 301 of the wiring board 300 are laid, by their end portions, on the multiple bumps 202 (formed along edges of recording element chip 200) of recording element chip 200, one for one, and heat and pressure is applied to the points of contact between the bumps 202 and leads 301 to weld the leads 301 to the bumps 202 one for one (inner lead bonding). It should be noted here that among the multiple leads 301 shown in the drawing, a pair of leads 301*a*, located at the ends, one for one, in terms of the direction parallel to the direction in which the leads 301 of the wiring board 300 arranged in parallel, are dummy leads, that is, leads which are not intended for electrical connection.

Incidentally, in this embodiment for concretely describing the present invention, the pair of end leads in terms of the abovementioned direction are dummy leads. However, the end leads do not need to be dummies. That is, the leads which are next to the projection 101 may be real leads, that is, electrical leads for electrical connection.

The projection 101 is between one of the end leads of the abovementioned group of leads 301 (inclusive of dummy leads 301*a*), and the edge 302 of the hole of the wiring board 300, which accommodates the recording element chip 200. The distance (d1) from the edge of the recording element chip 200 to the projection 101 is desired to be as small as possible; the gap between the edge of the recording element chip 200 and the projection 101 is desired to be the smallest one which can be afforded based on the current level of precision at which the components of an ink jet recording head can be manufactured and assembled. Further, it is desired to be no more than the interval between the adjacent two leads 301.

Figure 3:
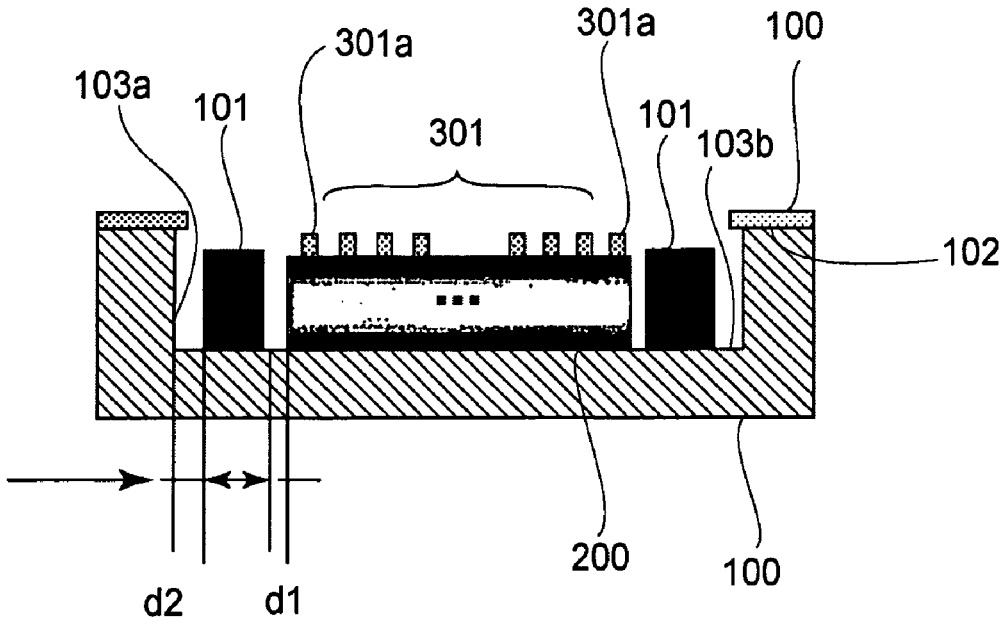
FIG. 3 is a schematic sectional view of the precursor of the ink jet recording head, shown in FIG. 2, at Plane A-A in FIG. 2.

FIG. 3 is a schematic sectional view of the precursor of the ink jet recording head shown in FIG. 2, at Plane A-A in FIG. 2. As is evident from FIG. 3, from the standpoint of minimizing the difference in vertical distance between the highest and lowest points of the area to be coated with the second sealant 500, the height of the projection 101 is desired to be as close as possible to the distance from the bottom 103*b* of the recess 103 to the surface (top surface) of the recording element chip 200.

Figure 4:
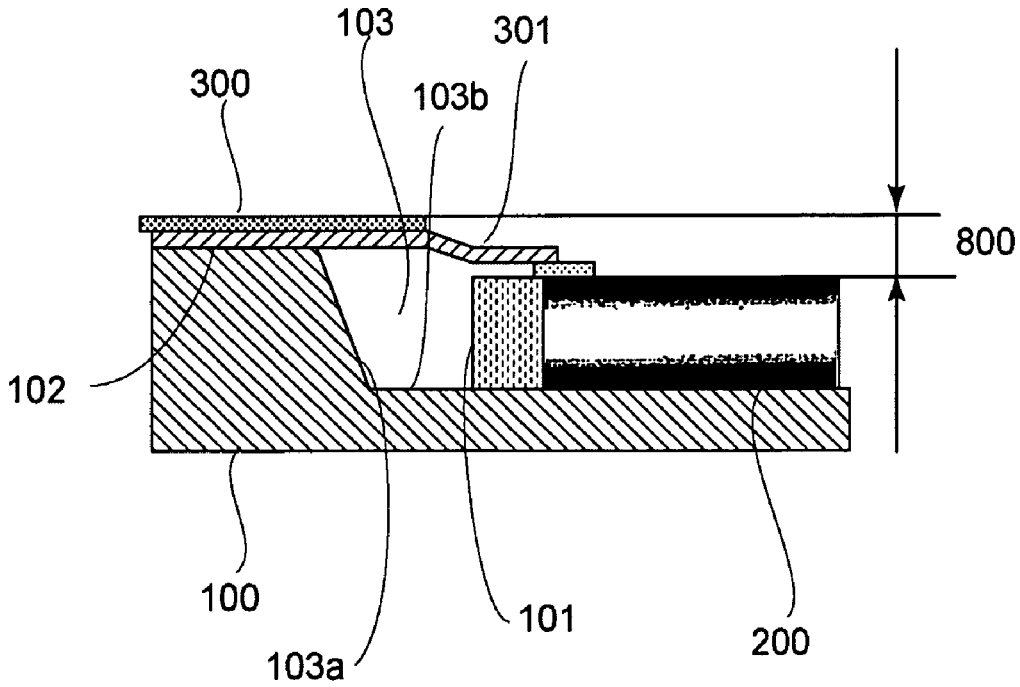
FIG. 4 is a sectional view of the precursor of the ink jet recording head, shown in FIG. 2, at Plane B-B in FIG. 2.

FIG. 4 is a schematic sectional view of the precursor of the ink jet recording head shown in FIG. 2, at Plane B-B in FIG. 2. As shown in FIG. 4, there is a space between each projection 101 and the adjacent lateral wall 103*a* of the recess 103. This space is for ensuring that when the first sealant 400 is applied to the peripheries of the recording element chip 200, there will be a passage which allows the first sealant 400 (FIG. 5) to circumvent the recording element chip 200 to reach the underside of the leads 301.

Figure 5:
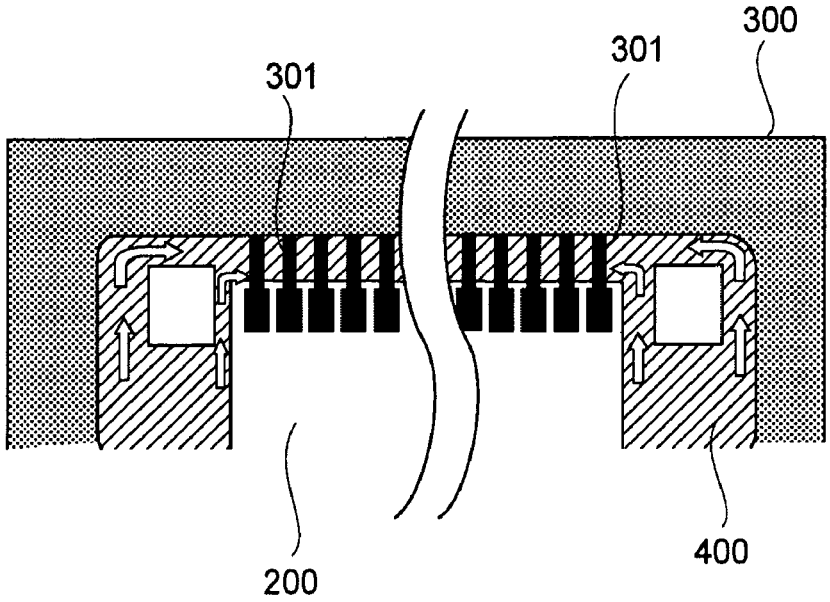
FIG. 5 is a schematic drawing which shows the flow of the first sealant.

FIG. 5 is a schematic plan view of the adjacencies of the electrical junctions and projections 101, and shows where and how the first sealant 400 circumvents the recording element chip 200. The first sealant 400 is applied to the peripheries of the recording element chip 200, more specifically, the gaps between the edges of the recording element chip 200, which are perpendicular to the edges along which the metallic pads are arranged. It is applied with the use of a dispenser, which is moved along the abovementioned edges of the recording element chip 200. After the first sealant 400 is applied, it flows into the under side of the leads 301 as shown by arrow marks in FIG. 5. That is, the body of first sealant 400, which enters the underside of the leads 301 from one side of the recording element chip 200, joins with the body of sealant 400, which enters the underside of the leads 301 from the other side, filling up thereby the space under the leads 301. As long as the first sealant 400 is allowed to flow into the underside of the leads 301 by an amount large enough to fill up the space under the leads 301, the values for the distances (d1) and (d2) shown in FIG. 3 are optional. For example, the testing of a recording head chip produced for testing, with the distances (d1 and d2)

set to 0.14 mm and 0.5 mm, respectively, confirmed that the first sealant 400 flowed into the space under the leads 301 by an amount large enough to fill up the space.

As described above, when the recording head in this embodiment was manufactured, the gaps between the recording element chip 200 and wiring board 300 were filled with the first sealant 400 by applying the first sealant 400 into the gaps which are between the recording element chip 200 and the lateral walls 103*a* of the recess 103, and which extend in the lengthwise direction of the recording head 200.

Referring again to FIG. 4, from the standpoint of preventing the above described "edge touch", the ink container 100 is designed so that after the fitting of the recording element chip 200 into the recess 103 of the bottom wall of the ink container 100, there will be the difference 800 in height between the top surface of the recording element chip 200 and the top surface of the wiring board 300.

Further, in order to prevent the problem that the electrical junctions between the recording element chip 200 and wiring board 300 corrode due to the adhesion of ink droplets or the like to the junctions, the second sealant 500 is applied in a manner to cover the electrical junctions after the peripheries of the recording element chip 200 are completely coated with the first sealant 400.

Figure 16:
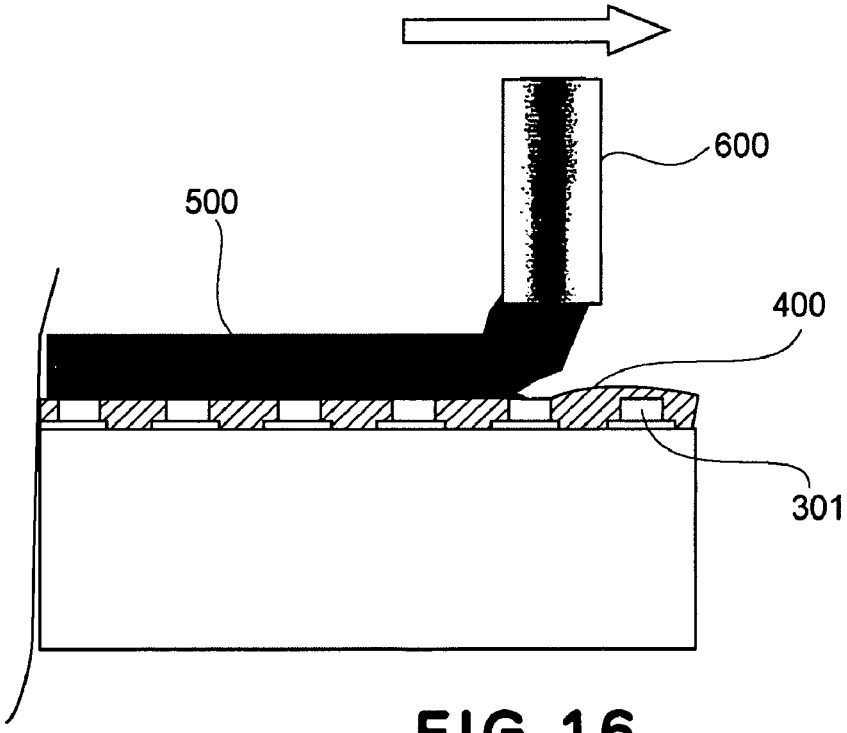
FIG. 16 is a schematic drawing which shows how the electrical junctions made by ILB are sealed.
Figure 17:
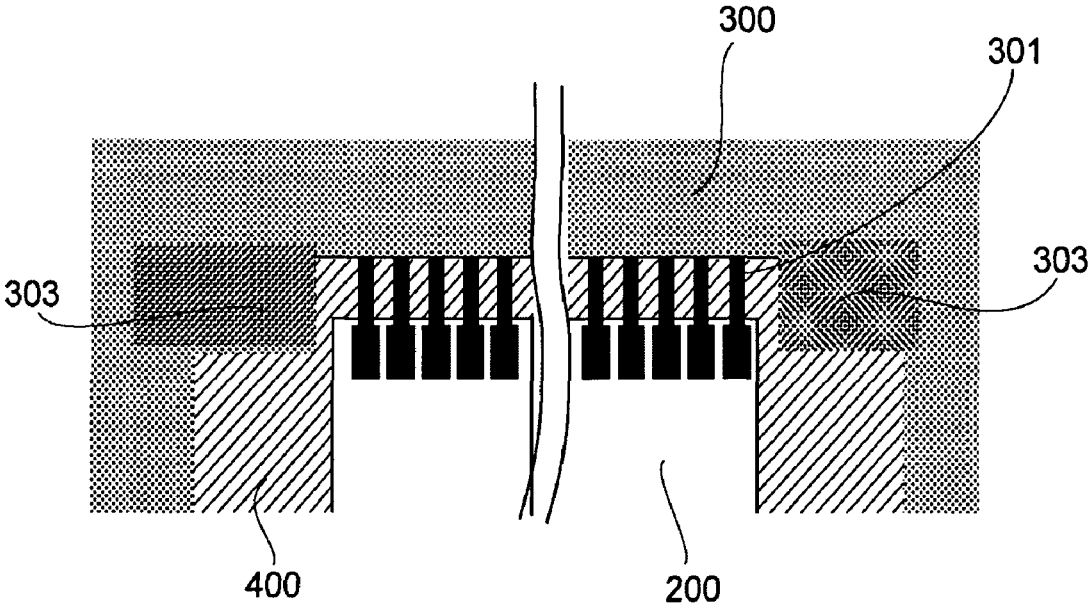
FIG. 17 is an enlarged view of the electrical junctions prior to the application of the second sealant thereto.
Figure 18:
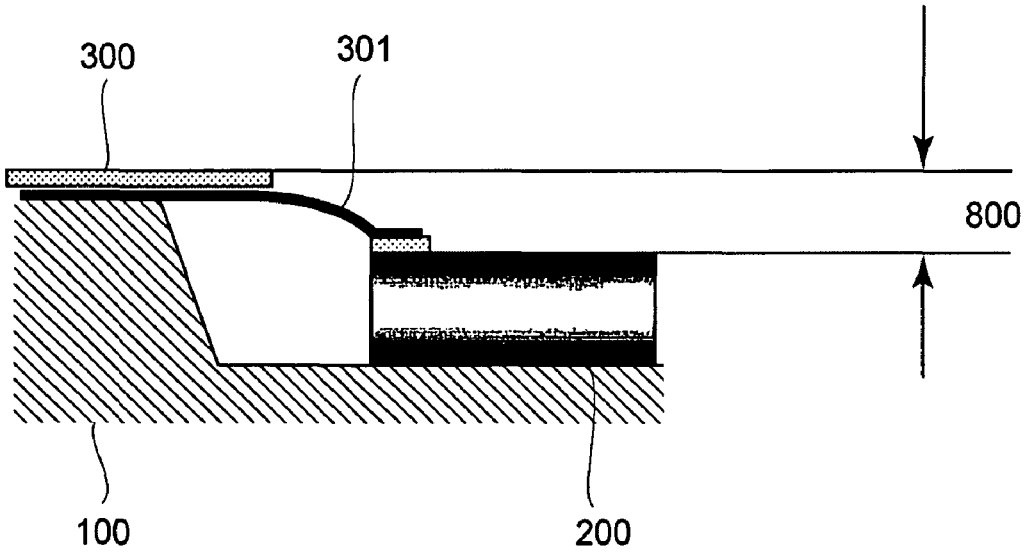
FIG. 18 is a schematic drawing which shows the difference in height (relative to bottom surface of recording element chip placement recess) provided between the top surface of wiring board and the top surface of recording element chip to prevent the "edge touch".
Figure 19A:
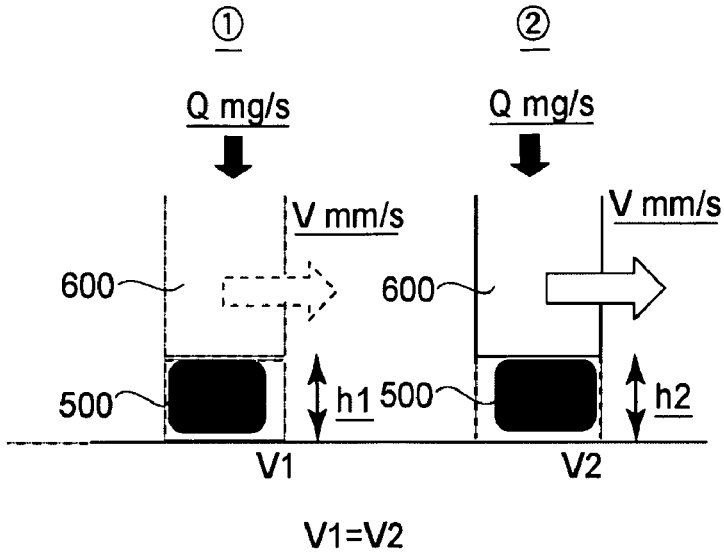
FIGS. 19A and 19B are schematic drawings which show the cause of the local narrowing of the second sealant.
Figure 19B:
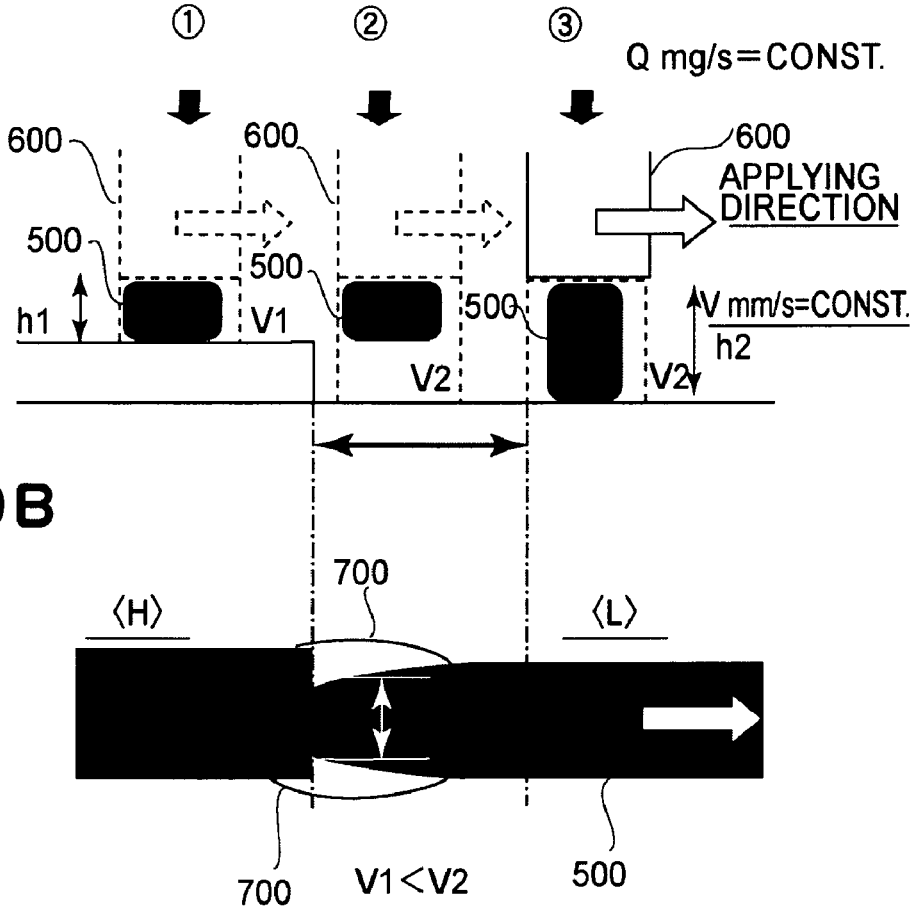

The actual method used for applying the second sealant 500 is the same as the conventional method shown in FIG. 16. That is, as the first sealant 400 is applied to the peripheries of the recording element chip 200, it moves into the space under the leads 301 of the wiring board 300, and fills up the space, because of its generation of capillary force. Further, as the first sealant 400 enters the space between the adjacent two leads 301 (inclusive of dummy leads 301*a*), it is pulled up by its surface tension, high enough for its top surface to become level with the highest portion of the leads 301. Thus, the body of first sealant 400 in the space between the adjacent two leads 301 is formed into, and remains in, a shape into which it is formed by the balance between its own weight and surface tension. The second sealant 500 is applied to the first sealant 400, directly onto the layer of first sealant 400, or with the presence of the leads 301 between the second sealant 500 and the layer of first sealant 400, so that it airtightly adheres to the layer of first sealant 400 as well as the leads 301 (FIG. 16).

After the application of the first and second sealants 400 and 500, the two layers of sealants 400 and 500 are thermally hardened.

The ink jet recording head, in this embodiment, manufactured through the steps described above, has a portion in which a part of the top surface of the wiring board 300, a part of each of the electrical junctions, a part of the top surface of the recording element chip 200, and multiple parallely positioned leads 301, are sealed with the layer of first sealant 400 and/or the layer of second sealants 500. It also has the four projections 101, which are in the four corner portions of the recess 103, one for one; more specifically, each projection 101 is between one of the two walls of the recording element chip accommodating hole of the wiring board, which is parallel to the lengthwise direction of the recording element chip 200, and one of the lengthwise edges of the recording element chip 200. The difference in height (relative to bottom surface 301*a* of recess 301) between the top surface of the projection 101 and the top surface of the recording element chip 200 is less than that between the top surface of the recording element chip 200 and the top surface of the wiring board 300.

The recording head in this embodiment is provided with a recording element chip unit attached thereto through the above described steps.

As will be evident from the above given description of this embodiment, the recording head in this embodiment has the multiple projections 101, which are on the outward side of the dummy leads 301*a* which makes up the outermost leads of the group of leads, in terms of the direction perpendicular to the lengthwise direction of the recording element chip 200. The difference in height (relative to bottom surface 301*b* of recess 301) between the top surface of the recording element chip 200 and the top surface of the projection 101 is smaller than that between the top surface of the recording element chip 200 and the top surface of the wiring board 300. That is, the ink jet recording head in this embodiment is designed so that in terms of its thickness direction, the top surface of the projection 101 is between the top surface of the recording element chip 200 and the top surface of the wiring board 300.

Figure 6A:
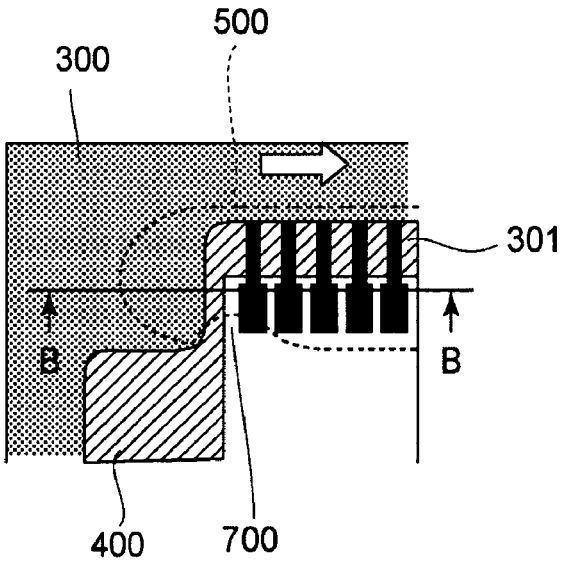
FIGS. 6A and 6B are schematic drawings which describe the result of the experiment in which the electrical junctions of a conventional ink jet recording head, which was made by ILB, were sealed with the sealants.
Figure 6B:
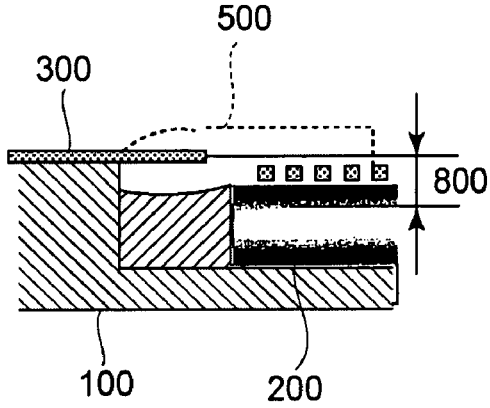
Figure 7A:
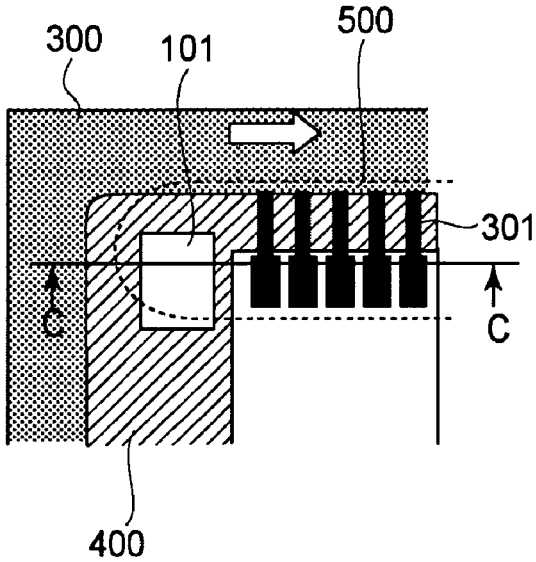
FIGS. 7A and 7B are schematic drawings which describe the result of the experiment in which the electrical junctions of the conventional ink jet recording head in this embodiment, which was made by ILB, were sealed with the sealants.
Figure 7B:
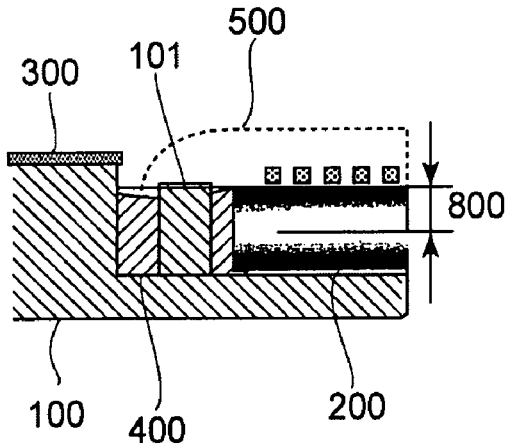

FIGS. 6A and 6B show the results of the experiment in which the sealants were applied to seal the electrical junctions of a conventional ink jet recording head, which were made by ILB, whereas FIGS. 7A and 7B show the results of the experiment in which the sealants were applied to seal the electrical junctions of the ink jet recording head in this embodiment, which were made by ILB. Incidentally, the experiments were carried out under the following conditions:

<Conditions>

Sealant: thermally curable epoxy resin (250 Pa·s/25° C.)

Application speed: 8.0 mm/s

Line of Application: straight line parallel to direction in which leads are arranged in parallel.

Referring to FIG. 6B, there is a substantial difference 800 in height (relative to bottom surface 301*b* of recess 301) of roughly 0.1-0.15 mm (within roughly 0.1 mm) between the edge of the top surface of the wiring board 300, which is adjacent to the point at which the application of second sealant 500 is started to seal the electrical junctions made by ILB, and the edge of the top surface of the recording element chip 200. As the second sealant 500 is applied in the direction indicated by an arrow mark in FIG. 6A, it is affected by the abovementioned difference 800 in height. That is, it was confirmed that the body of second sealant 500 reduced in width on the downstream side (in terms of the direction in which the second sealant 500 is applied) of the edge of the wiring board 300; in other words, the body of second sealant 500 became "narrow", as it was applied.

In comparison, referring to FIGS. 7A and 7B, in the case of the recording head in this embodiment, it was confirmed that even when the second sealant 500 was applied under the same condition as that under which the second sealant 500 is applied to the electrical junctions of a conventional ink jet recording head, the narrowing 700 of the body of applied second sealant 500, as shown in FIG. 6A, did not occur. Incidentally, it was confirmed by this experiment that even when there was a height difference of roughly 20 μm-70 μm between the top surface of the projection 101 and the top surface of the recording element chip 200, the narrowing 700 of the body of applied second sealant 500 did not occur.

It is reasonable to think from the above given description of this embodiment that as long as the requirement that the ink container 100 is to be provided with the abovementioned projections 101 before the starting of the application of the sealant, and the requirement that the sealants are to be applied from the side where one of the projection 101 is located, in the direction parallel to the direction in which the multiple leads are disposed in parallel, are satisfied, the body of applied second sealant 500 does not locally narrow.

Embodiment 2

Next, the recording head in the second embodiment of the present invention will be described. The recording head in this embodiment is the same in structure as the recording head in the first embodiment. Therefore, the structural components of the recording head in this embodiment, which are the same as the counterparts in the first embodiment, are given the same referential symbols as those given to the counterparts, and will be described.

Figure 8:
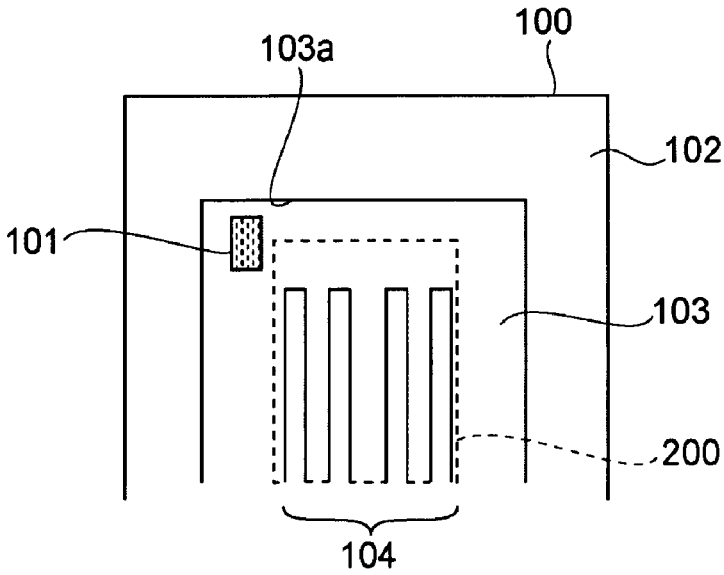
FIG. 8 is a schematic bottom view of the ink container of the ink jet recording apparatus in the second embodiment of the present invention.
Figure 9:
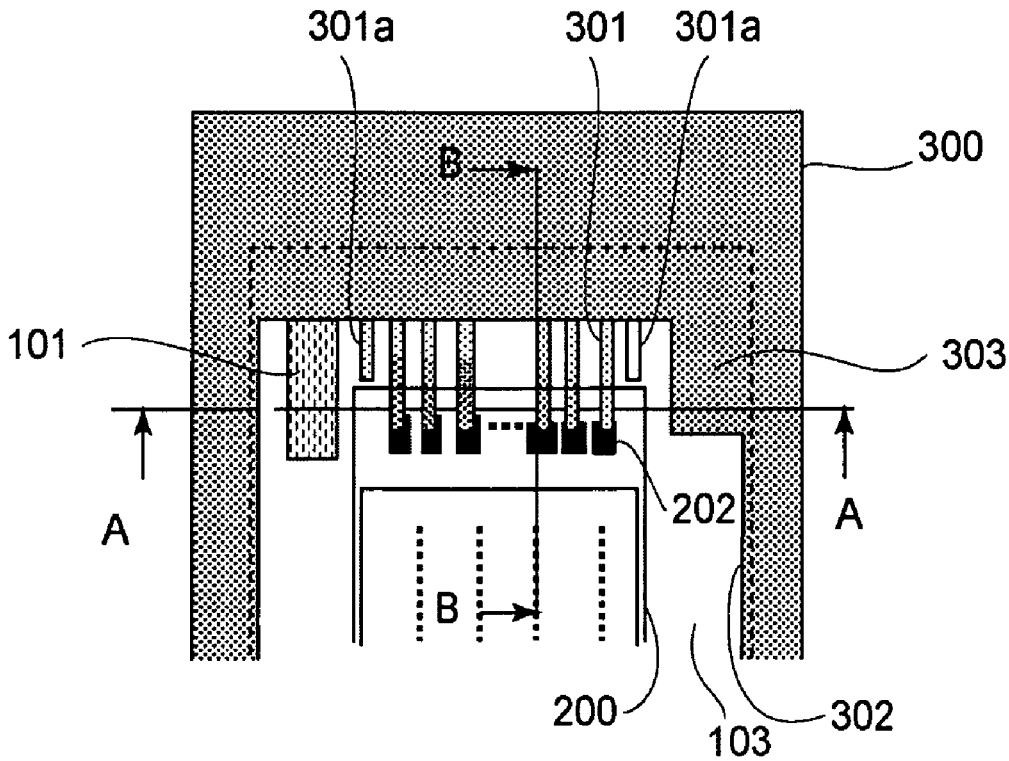
FIG. 9 is a schematic bottom view of a part of the ink container of the ink jet recording head shown in FIG. 8, showing the bottom surface of the ink container to which the recording element chip and wiring board have been attached.
Figure 10:
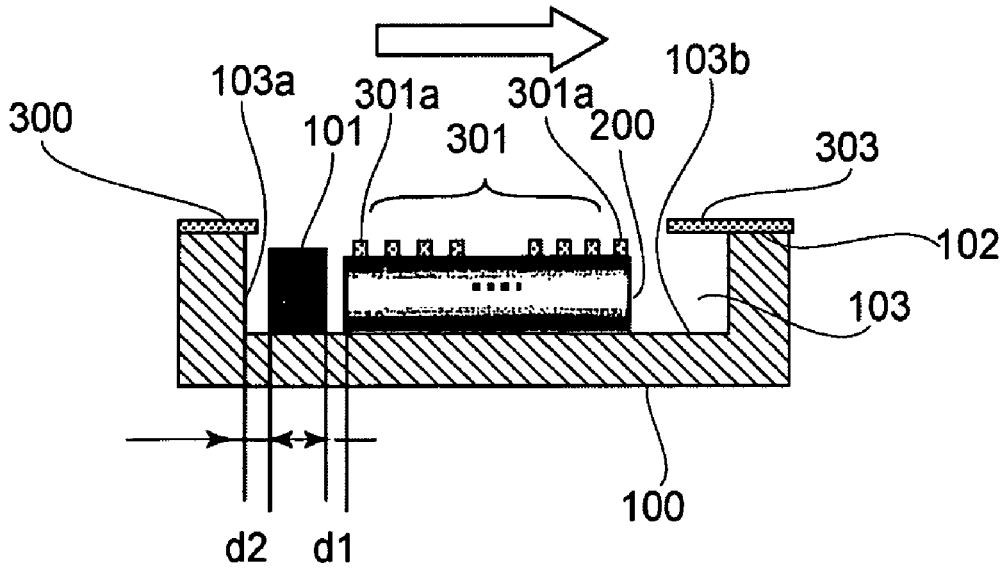
FIG. 10 is a sectional view of the precursor of the ink jet recording head, shown in FIG. 9, at Plane A-A in FIG. 9.

FIG. 8 is a schematic plan view of a part of the bottom of the ink container 100 of the recording head in this embodiment, and shows the general structure thereof. FIG. 9 is a schematic plan view of the same portion of the ink container 100 of the recording head in this embodiment as that shown in FIG. 8, after the wiring board 300 was bonded to the preset wiring board attachment area 102 of the ink container 100, the recording element chip 200 was bonded to the bottom surface of the recess 103, and electrical connection was made, by ILB, between the wiring board 300 and recording element chip 200. FIG. 10 is a schematic sectional view of the precursor of the recording head, which is in the state shown in FIG. 9, at Plane A-A in FIG. 9.

As will be evident from these drawings, the recording head in this embodiment also is provided with the projections 101, which are on the bottom surface 103*b* of the recess 103 of the ink container 100. However, it is different from the recording head in the first embodiment in that it is provided with only one projection 101, per lengthwise end of the recording element chip 200, which is located on the outward side of the recording head relative to the end lead (which in this embodiment is dummy lead 301*a*, that is, leftmost lead in FIG. 9) in terms of the direction in which the leads are arranged in parallel.

In the sealant application step in the manufacturing of the recording head in this embodiment, the unshown second sealant is applied in the direction indicated by an arrow mark in FIG. 10. That is, the application of the sealant is started from the side where the projection 101 is located.

It should be noted here that there is a space between the lateral wall 103*a* of the recess 103 and the projection 101 as shown in FIG. 10. Also, it is desired that the distance (d1) between the recording element chip 200 and projection 101 is as small as possible; the gap between the edge of the recording element chip 200 and the projection 101 is desired to be the smallest one which can be afforded based on the current level of precision at which the components of an ink jet recording head can be manufactured and assembled. Further, it is desired to be less than the interval between the adjacent two leads 301.

Also in the case of the recording head in this embodiment, the presence of the projection 101 reduces the difference in height between the edge of the wiring board 300, which is in the adjacencies of the second sealant application starting point, and the recording element chip 200. Therefore, it prevents the problem that the body of applied second sealant becomes locally narrow as it is applied.

Further, the wiring board 300 in this embodiment is provided with overhangs 303 which extend in a manner to cover the corresponding corner portions of the recess 103. More specifically, referring to FIGS. 9 and 10, the overhang 303 is located on the opposite side of the recess 103 from where the projection 101 is present. It extends toward the projection 101.

Figure 11A:
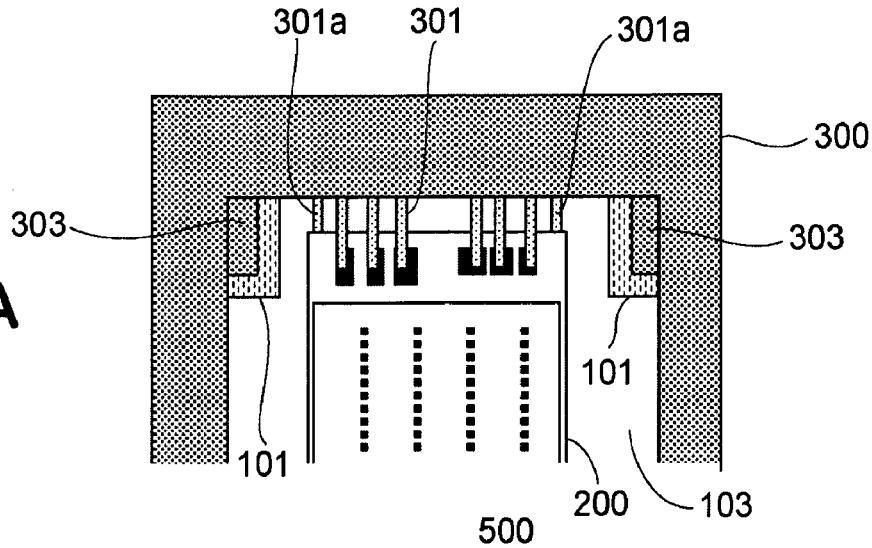
FIGS. 11A, 11B, and 11C are schematic drawings of the modified version of the ink jet recording head in the second embodiment of the present invention.
Figure 11B:
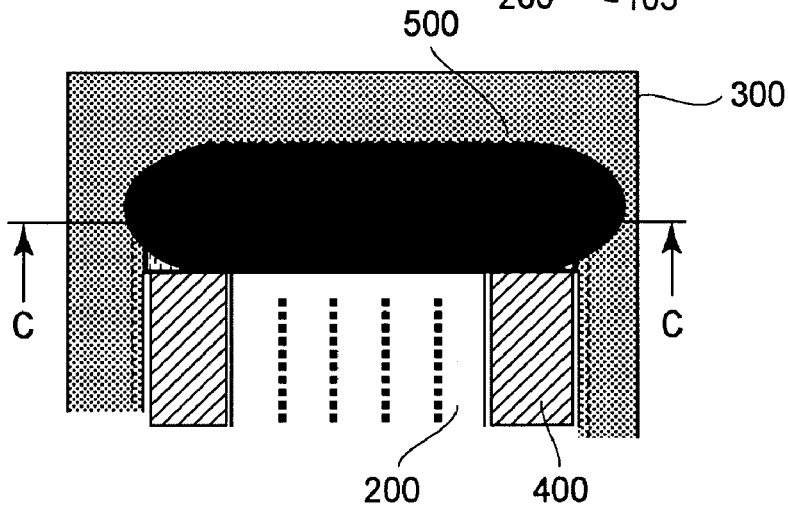

Incidentally, the wiring board 300 may be provided with four overhangs 303, which extend over the four corners of the recess 103, one for one, as shown in FIGS. 11A-11B. In this case, the ink container 100 is provided with four projections 101, which protrude from the four corner areas of the bottom surface 103*b* of the recess 103 of the ink container 100. Further, referring to FIG. 11C, each overhang 303 partially overlaps with the top surface of the corresponding projection 101, although the bottom surface of the overhang 303 is not in contact with the top surface of the projection 101.

Figure 11C:
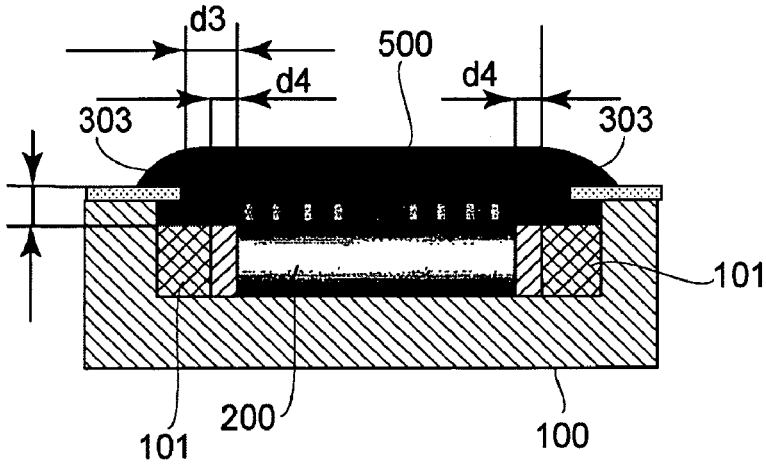
Figure 12:
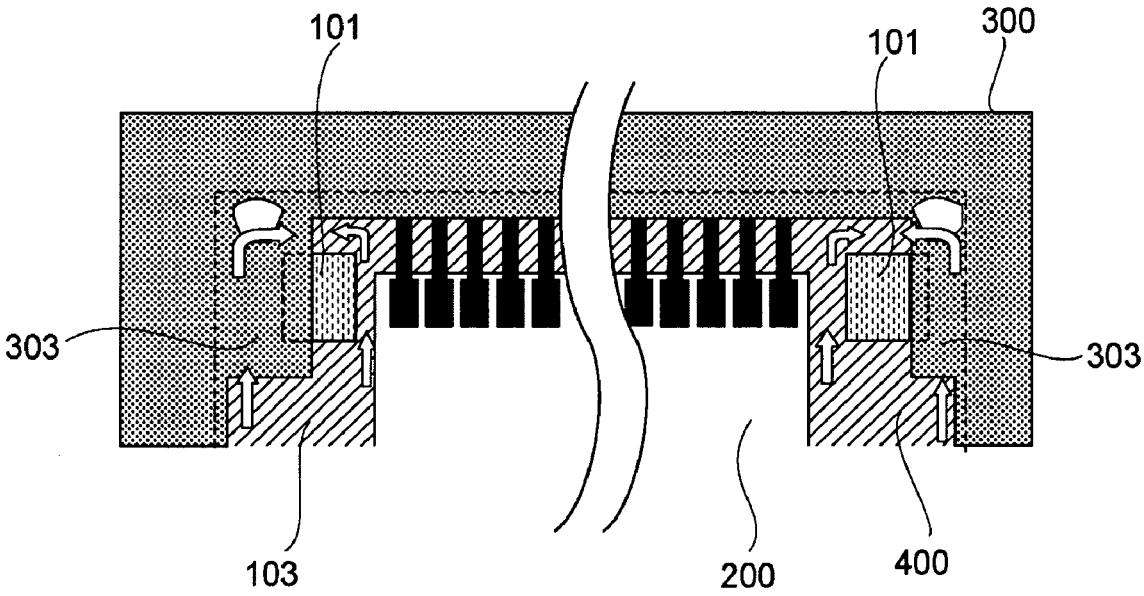
FIG. 12 is a schematic drawing which shows how, where, and why bubbles collect in the corners of the recording element chip placement recess when the first sealant is applied.

Also referring to FIG. 11C, the distance (d4) between the projection 101 and recording element chip 200 is smaller than the distance (d3) between the overhang 303 and recording element chip 200. That is, in terms of the direction in which the leads 301 are arranged in parallel, the projection 101 is closer to the recording element chip 200 than the overhang 303 (d4<d3). Further, the height of the projection 101 relative to the bottom surface 103*b* is roughly the same as that of the recording element chip 200 after the bonding of the chip 200 to the ink container 100. More specifically, the height of the projection 101 is such that the difference in height between the top surface of the recording element chip 200 and the top surface of the projection 101 is smaller than that between the top surface of the recording element chip 200 and the top surface of the wiring board 300, and also, such that the height of the top surface of the projection 101 is as close as possible to that of the recording element chip 200.

FIG. 11B shows the precursor of the recording head in the condition in which the precursor will be after the application of the first and second sealants 400 and 500 to the peripheries of the recording element chip 200. The second sealant 500 has been applied so that it extends from the application start point, which is on one of the overhangs 303 of the wiring board 300, to the application ending point, which is on the other overhang 303, so that all the real leads 301 and dummy leads 303*a*, which are between the two overhangs 303 (FIG. 11A), are completely covered with the second sealant 500.

If the overhang 303 of the wiring board 300 overlaps with the projection 101, it is possible that when the first sealant 400 flows into the space under the leads 301 by circumventing the recording element chip 200, bubbles will collect in the corners of the recess 103. This problem occurs because as the first sealant 400 applied to the peripheries of the recording element chip 200 flows into the closed space surrounded by the lateral walls of the recess 103, corresponding lateral surfaces of the projection 101, the bottom surface of the overhang 303, and the advancing body of first sealant 400, while swallowing air, by circumventing the recording element chip 200. If bubbles collect in the abovementioned corners, it is possible that when the layer of first sealant 400 is thermally cured, the layer of the first sealant 400 will be disturbed in shape by the expansion of the bubbles.

In this embodiment, therefore, if the recording head is designed so that the overhang 303 of the wiring board 300 overlaps with the projection 101, it is desired that the recording head is also designed so that there is no space between the projection 101 and the corresponding lateral wall 103*a* of the recess 103. As long as there is no space between the projection 101 and the corresponding lateral wall 103*a* of the recess 103, that is, as long as no space is present between the projection 101 and the lateral wall 103*a* of the recess 103, the advancing body of first sealant 400 does not create the abovementioned closed space, and therefore, no bubble collects in the corners.

Incidentally, choosing a point on the smooth top surface of one of the overhangs 303 of the wiring board 300, which, as the first sealant application starting point, and a point on the smooth top surface of the other overhang 303, as the first sealant application ending point, has a merit in that it makes it easier to determine the position and shape of the body of the applied sealant, when examining the position and shape of the body of applied sealant by detecting the position of edges using an image processing method.

Embodiment 3

Next, referring to FIGS. 13A, 13B, 13C and 13D, the recording head in the third embodiment of the present invention will be described.

Figure 13A:
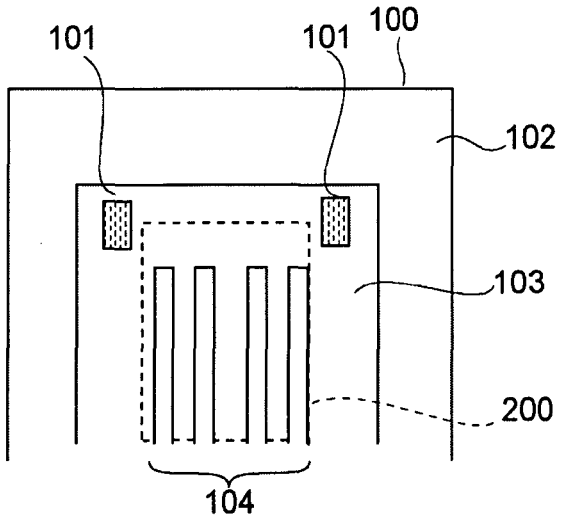
FIGS. 13A, 13B, 13C and 13D are schematic drawings of the ink jet recording head in the third embodiment of the present invention.
Figure 13B:
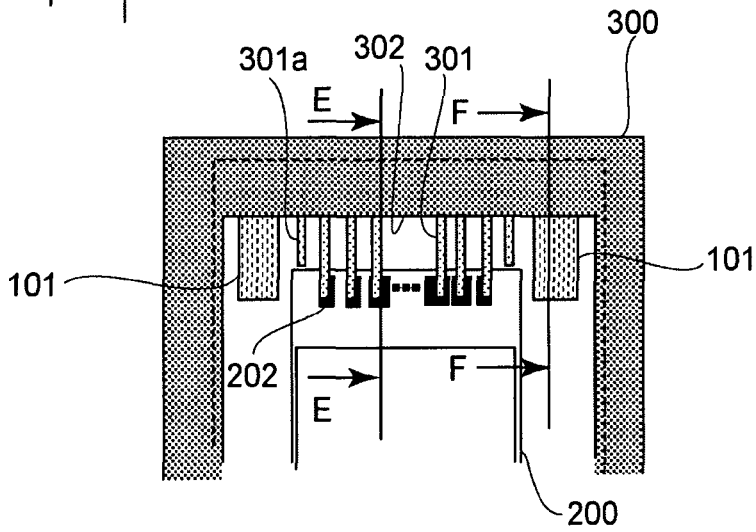
Figure 13C:
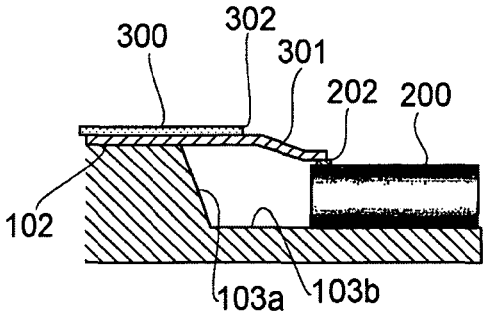
Figure 13D:
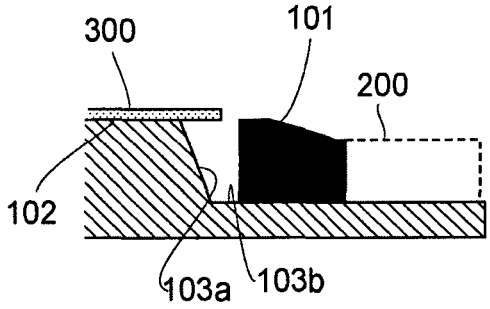
Figure 14A:
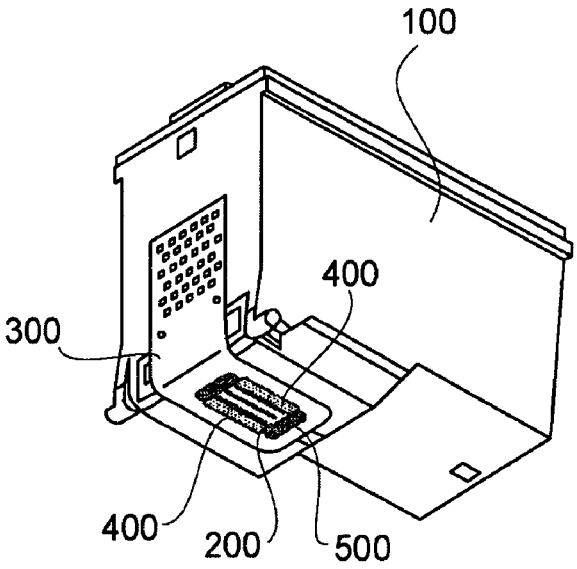
FIGS. 14A and 14B are schematic perspective views of the ink jet recording head in accordance with the prior art, showing the general structure of the ink jet recording head.
Figure 14B:
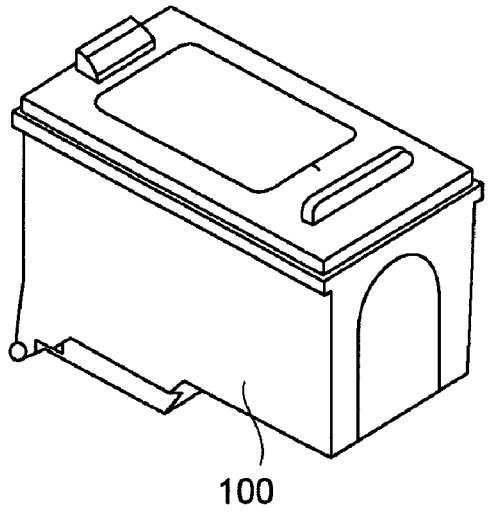
Figures 15A, 15B, 15C:
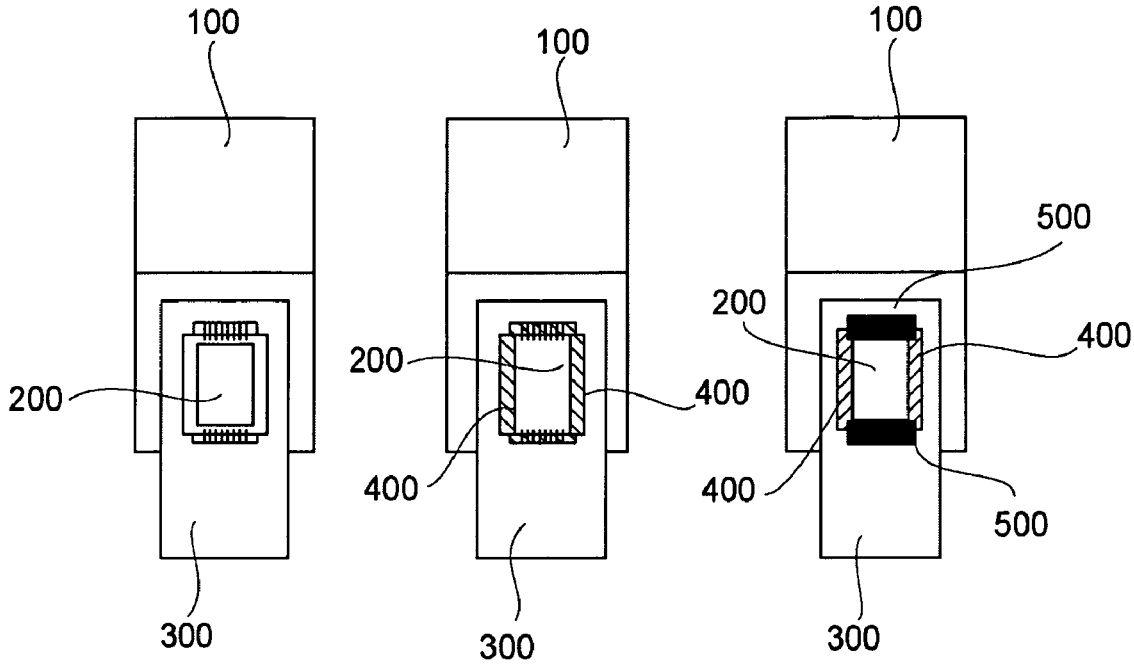
FIGS. 15A, 15B, and 15C are schematic drawing of the precursors of the ink jet recording head in accordance with the prior art, showing the steps, one for one, of the process for manufacturing the ink jet recording head.

FIG. 13A is a schematic plan view of a part of the downwardly facing side of the ink container 100 of the recording head in this embodiment. FIG. 13B is a schematic plan view of the downwardly facing side of the ink container 100 after the bonding of the wiring board 300 to the wiring board attachment area 102 of the ink container 100, bonding of the recording element chip 200 to the bottom surface 103*b* of the recess 103, and electrical connection of the wiring board 300 to the recording element chip 200 by ILB. FIG. 13C is a schematic sectional view of the electrical junctions between the wiring board 300 and recording element chip 200, and their adjacencies, at Plane E-E in FIG. 13B. FIG. 13D is a schematic sectional view of the ink container 100, at Plane F-F in FIG. 13B.

The basic structure of the recording head in this embodiment is the same as that of the recording head in the above described first embodiment. Therefore, the structural features of the recording head in this embodiment, which are the same as those of the recording head in the first embodiment, will not be described; only the different features of this recording head from those of the recording head in the first embodiment will be described below.

The recording head in this embodiment is different from the recording head in the first embodiment only in the shape of the top surface of the projection 101. More concretely, referring to FIG. 13D, the top surface of the projection 101 in this embodiment is partially curved in such a form that its curvature matches the curvature of each lead 301 and each dummy lead 301*a* (FIG. 13C), which extend from the edge 302 of the recording element chip accommodating hole of the wiring board 300. Incidentally, in this embodiment, in order to prevent the edge 302 of the recording element chip accommodating hole of the wiring board 300 from overlapping with the top surface of the projection 101, the overhang 303 is rendered shorter than the overhang 303 in the second embodiment.

In this embodiment, the top surface of the projection is curved in such a form that its curvature matches those of each lead 301 and each dummy lead 301*a*. Therefore, as the second sealant 500 (unshown) is applied to cover the group of leads 301, it smoothly flows, being therefore unlikely to become locally narrow. From the standpoint of allowing the second sealant to flow smoothly (flatly), the projection 101 may be formed so that the top surface has an angle which approximates the curvatures of the lead 301 and dummy lead 301*a*.

The projection 101 shaped as described above can be easily formed by one of the known methods, for example, injection molding. Further, the projection 101 can be easily modified in the shape of its top surface by modifying in shape the metallic mold for the projection 101.

As described above, the recording heads in the above described first to third embodiments are significantly smaller in the difference in height (relative to bottom surface of recording element chip placement recess of ink container) between the surface area of the wiring board, to which sealant is to be applied, and the surface area of the recording element chip, to which sealant is to be applied, than a recording head in accordance with the prior art. Therefore, after sealant is applied to the abovementioned area, it remains stable in shape. In other words, the present invention makes it possible to more reliably apply the sealant at a higher speed, making it thereby possible to improve an ink jet head manufacturing process in productivity.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 096408/2007 filed Apr. 2, 2007, which is hereby incorporated by reference.

What is claimed is:

1. An ink jet recording head comprising:

a recording element substrate having an ejection outlet for ejecting ink;

an electric wiring member connected to said recording element substrate at an electrical connecting portion to supply electric power to said recording element substrate, said electric wiring member including an array of leads;

a supporting portion for supporting said recording element substrate and said electric wiring member, said supporting portion including a surface supporting said electric wiring member and a recessed bottom surface for supporting said recording element substrate, wherein said electric wiring member is supported such that an upper surface thereof is at a position higher than an upper surface of said recording element substrate;

a sealed region of sealing material sealing said electric wiring member, said sealed region covering a part of the upper surface of said electric wiring member, the electrical connecting portion, a part of the upper surface of said recording element substrate, and said array of leads; and a projection provided between said electric wiring member and said recording element substrate at an end, with respect to a direction of arrangement of said array, of said array in said sealed region, wherein an upper surface of said projection is at a different level than the upper surface of said recording element substrate, and a level difference between the upper surface of said projection and the upper surface of said recording element substrate is less than a level difference between the upper surface of said recording element substrate and the upper surface of said electric wiring member.

2. An ink jet recording head according to claim 1, wherein said electric wiring member has an extension overlapping with the upper surface of said projection.

3. An ink jet recording head according to claim 1, wherein said leads are curved, and the upper surface of said projection has a surface corresponding to the curvature of said leads.

4. An ink jet recording head according to claim 1, wherein said projection extends from the recessed bottom surface.

5. An ink jet recording head according to claim 4, wherein said projection is integral with said supporting portion.

6. A manufacturing method for an ink jet recording head, said method comprising:

a step of preparing a recording element substrate having an ejection outlet for ejecting ink;

a step of preparing an electric wiring member connected to the recording element substrate at an electrical connecting portion to supply electric power to the recording element substrate, the electric wiring member including an array of leads;

a step of preparing a supporting portion for supporting the recording element substrate and the electric wiring member, the supporting portion including a surface supporting the electric wiring member and a recessed bottom surface for supporting the recording element substrate, wherein the electric wiring member is supported such that an upper surface thereof is at a position higher than an upper surface of the recording element substrate;

a step of providing a projection between the electric wiring member and the recording element substrate at an end, with respect to a direction of arrangement of the array, of the array in a sealed region, wherein an upper surface of the projection is at a different level than the upper surface of the recording element substrate, and a level difference between the upper surface of the projection and the upper surface of the recording element substrate is less than a level difference between the upper surface of the recording element substrate and the upper surface of the electric wiring member; and a step of applying sealing material along the direction from a side where the projection is provided, to provide the sealed region to seal the electric wiring member, the sealed region covering a part of the upper surface of the electric wiring member, the electrical connecting portion, a part of the upper surface of said recording element substrate, and the array of leads.

* * * * *